US008097094B2

(12) United States Patent
Murakami

(10) Patent No.: US 8,097,094 B2
(45) Date of Patent: Jan. 17, 2012

(54) HIGH-STRENGTH ELECTRICAL STEEL SHEET AND PROCESSED PART OF SAME

(75) Inventor: Hidekuni Murakami, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 276 days.

(21) Appl. No.: 10/574,553

(22) PCT Filed: Oct. 6, 2004

(86) PCT No.: PCT/JP2004/015098

§ 371 (c)(1),
(2), (4) Date: Apr. 3, 2006

(87) PCT Pub. No.: WO2005/033349

PCT Pub. Date: Apr. 14, 2005

(65) Prior Publication Data

US 2007/0062611 A1 Mar. 22, 2007

(30) Foreign Application Priority Data

Oct. 6, 2003 (JP) ..... 2003-347113
May 19, 2004 (JP) ..... 2004-148993

(51) Int. Cl.
*H01F 1/147* (2006.01)

(52) U.S. Cl. ..... 148/307; 148/332; 148/117; 148/118

(58) Field of Classification Search ..... 148/110–113, 148/307, 332; 420/117–118, 89–91
See application file for complete search history.

(56) References Cited

U.S. PATENT DOCUMENTS 5,084,112 A * 1/1992 Tachino et al. ..... 148/111
7,513,959 B2 * 4/2009 Takashima et al. ..... 148/307

FOREIGN PATENT DOCUMENTS

EP 1 580 289 9/2005
JP 61-084360 4/1986
JP 61-087848 5/1986
JP 01-162748 6/1989

(Continued)

OTHER PUBLICATIONS

Computer-generated English translation of Japanese patent 09-170053, Hasegawa Morihiro et al. Jun. 30, 1997.*
Computer-generated English translation of Japanese patent 2000-239808, Masuda Akitomo, Sep. 5, 2000.*

(Continued)

*Primary Examiner* — Deborah Yee
(74) *Attorney, Agent, or Firm* — Kenyon & Kenyon LLP

(57) ABSTRACT

The present invention has as its object to stably produce a high strength electrical steel sheet and a processed part of the same which is high in strength and has wear resistant and is superior in magnetic flux density and core loss without greatly changing the cold rollability and production processes from those of conventional electrical steel sheet and provides a high strength electrical steel sheet characterized by containing, by mass %, C: 0.06% or less, Si: 0.2 to 6.5%, Mn: 0.05 to 3.0%, P: 0.30% or less, S or Se: 0.040% or less, Al: 2.50% or less, Cu: 0.6 to 8.0%, N: 0.0400% or less, and a balance of Fe and unavoidable impurities and containing in the steel a metal phase composed of Cu of a size of 0.1 μm or less. The method of production of the same comprises holding in a temperature range of 300° C. to 720° C. for 5 seconds or more for heat treatment.

5 Claims, 2 Drawing Sheets

FOREIGN PATENT DOCUMENTS

| | | | |
|---|---|---|---|
| JP | 08-041601 | | 2/1996 |
| JP | 09-170053 | * | 6/1997 |
| JP | 09-209039 | * | 8/1997 |
| JP | 09-241793 | * | 9/1997 |
| JP | 10-183247 | | 7/1998 |
| JP | 11-293338 | | 10/1999 |
| JP | 2001-234303 | | 8/2001 |
| JP | 2003-89820 | | 3/2003 |
| JP | 2004-84053 | | 3/2004 |
| JP | 2004-183066 | | 7/2004 |
| JP | 2004-315956 | | 11/2004 |
| JP | 2004-339603 | | 12/2004 |
| WO | WO 99/47718 | | 9/1999 |

OTHER PUBLICATIONS

"Essential and incidental elements in steel and cast iron", Table 1.1, Introduction to Steels and Cast iron, ASM, 1994.*

Machine-English translation of Japanese patent 10-219396, Okayama Hironao et al. Aug. 8, 1998.*

R. O'Handley, "*Modern Magnetic Materials, Principles and Applications*," Wiley Interscience, New York, p. 20-21, 370-371, 387, 787 (2000).

Supplementary European Search Report dated Nov. 9, 2009, issued in corresponding European Patent Application No. 04792338.8.

Japanese Office Action dated Aug. 11, 2010 issued in corresponding Japanese Application No. 2005-514520, with English translation.

* cited by examiner

HIGH-STRENGTH ELECTRICAL STEEL SHEET AND PROCESSED PART OF SAME

TECHNICAL FIELD

The present invention provides a high strength electrical steel sheet, in particular a non-oriented electrical steel sheet, containing Cu appropriately treated to form a fine Cu metal phase maintaining good magnetic properties. The electrical steel sheet obtained by the present invention is especially suited to its use in high speed rotary machines requiring strength, electromagnetic switches requiring wear resistance, etc.

BACKGROUND ART

Until recently the rotational speed required in rotary devices was at most been about 100,000 rpm and laminated electrical steel sheet was used for the material of rotor cores. Recently, superhigh speed rotation as high as 200,000 or 300,000 rpm has been demanded and thus the centrifugal force applied to the rotor could exceed the strength of the electrical steel sheet. Further, inner magnet type motors are increasingly used and the load applied to the material of the rotor during rotation becomes large. Thus, the fatigue strength of the material is becoming important in many cases.

In other cases, the contact surface of electromagnetic switch is worn during its use, and thus magnetic materials superior in not only electromagnetic properties, but also wear resistance are desired for the use.

To meet with these needs, recently high strength non-oriented electrical steel sheet has been studied. Several proposals have been made. For example, Japanese Published Patent Application No. 1-162748 and Japanese Published Patent Application No. 61-84360 propose a material using a slab increased in Si content and further containing one or more of Mn, Ni, Mo, Cr, and other solid solution strengthening components, but the sheet is liable to break easily in rolling and causes less productivity and less yield. Thus the sheet has a room for improvement. Furthermore, since Ni, Mo or Cr are included in large amounts in the steel, the material becomes extremely expensive.

Japanese Published Patent Application No. 61-87848 discloses producing high strength non-oriented electrical steel sheet by rapid solidification from a melt containing 2.5% or more of Si. Japanese Published Patent Application No. 8-41601 discloses improving the rollability by wrapping a high Si steel containing 2.5% or more Si by low Si steel containing 2.0% or less Si. Since these proposals use special processes, the sheets cannot be produced by the production facilities for conventional electrical steel sheet and therefore are difficult to be produced industrially.

With the above methods utilizing solid solute strengthening by solute elements, from the view point of magnetic properties, the saturation magnetic flux density of the material is inherently low, and thus the magnetic flux density of the product sheet is inevitably low. Further, from the view point of crystal structure, the methods inherently refines grain size, so while these are preferable in terms of increasing the strength, there is the problem that the core loss ends up rising.

Further, to strengthen a material, utilizing precipitates may also be considered, but precipitates also end up degrading the magnetic properties from the viewpoint of the magnetic flux density and core loss due to the effects of the precipitates themselves and the refining the crystal structure. In this way, high strength electrical steel sheets have inherent problems wherein the magnetic properties originally required are remarkably degraded.

In particular, with materials strengthened by refining grain size or by precipitates, when punched to an article for electrical appliances such as motors etc., in the stress relief annealing (SRA) process for relieving the fabrication stress introduced to the steel sheets, growth of the crystal structure or precipitates occurring while holding the steel at a high temperature is unavoidable and therefore the strength is decreased. Further, use of high strength materials accelerates the wear of the dies when punching the steel into parts for electrical appliances, in particular in the shearing process, so becomes a cause of raising the cost of production of the electrical appliances.

DISCLOSURE OF THE INVENTION

In this way, various proposals have been made regarding high strength electrical steel sheet, but the fact is that it is not yet possible to stably produce such steel industrially securing the required magnetic properties and using an conventional electrical steel sheet production facility. Further, there are also many remaining problems such as softening in the stress relief annealing performed after fabrication or the wear of the dies during punching parts for electrical appliances.

The object of the present invention is to stably produce high strength electrical steel sheet which is high in strength and wear resistance and is superior in magnetic properties such as magnetic flux density and core loss without greatly changing the productivity such as cold rollability from that of conventional electrical steel sheet production process.

Another object is the production of an electrical steel sheet which is relatively soft until the completion of stamping or other processing of the parts for the electrical applications, but develops hardening by heat treatment after the processing, having high strength and wear resistance as well as excellent magnetic properties.

The present invention has been made to solve the above problems of providing the electrical steel sheet including Cu followed by proper heat treatment so as to include a metal phase fine Cu and obtaining high strength, high wear resistant electrical steel sheet without inviting a deterioration of magnetic properties or productivity that are accompanied by conventional high strength electrical steel sheet. The gist of the present inventions are as follows.

(1) A high strength electrical steel sheet and a processed part of the same characterized by containing, by mass %, C: 0.06% or less, Si: 0.2 to 6.5%, Mn: 0.05 to 3.0%, P: 0.30% or less, S or Se: 0.040% or less, Al: 2.50% or less, Cu: 0.6 to 8.0%, N: 0.0400% or less, and a balance of Fe and unavoidable impurities and containing in the steel a metal phase comprised of Cu of a diameter of 0.1 μm or less.

(2) A high strength electrical steel sheet and a processed part of the same as set forth in (1), characterized by further containing, by mass %, one or more of Nb: 8% or less, Ti: 1.0% or less, B: 0.010% or less, Ni: 5% or less, and Cr: 15.0% or less.

(3) A high strength electrical steel sheet and a processed part of the same as set forth in (1) or (2), characterized by further containing, by mass %, one or more of Bi, Mo, W, Sn, Sb, Mg, Ca, Ce, La, and Co in a total of 0.5% or less.

(4) A high strength electrical steel sheet and a processed part of the same as set forth in any one of (1) to (3), wherein the number density of the metal phase comprised of Cu present in said steel is 20 /$\mu m^3$ or more.

(5) A high strength electrical steel sheet and a processed part of the same as set forth in any one of (1) to (4), wherein said steel sheet or the part has an average crystal grain size of 30 to 300 μm.

(6) A high strength electrical steel sheet and a processed part of the same as set forth in any one of (1) to (5), wherein the steel sheet or the part has a worked structure remaining in it.

(7) A high strength electrical steel sheet and a processed part of the same as set forth in any one of (1) to (6), characterized in that the steel sheet or the part contains Nb carbide or nitride.

(8) A method of production of a high-strength electrical steel sheet and a processed part of the same as set forth in any one of (1) to (7), wherein the sheet or the part is held at a temperature range of 300° C. to 720° C. for 5 seconds or more for heat treatment in the production process.

(9) A method of production of a high strength electrical steel sheet and a processed part of the same as set forth in (8), characterized by, as said heat treatment, holding at a temperature range of 300° C. to 720° C. for 5 seconds or more in a cooling process from a temperature range of 750° C. or more in a final heat treatment process.

(10) A method of production of a high strength electrical steel sheet and a processed part of the same as set forth in (8) or (9), characterized by, after the heat treatment, holding in a temperature range over 800° C. for 20 seconds or more.

(11) A processed part of a high strength electrical steel sheet as set forth in any one of (1) to (7), characterized wherein the part is heat treated after processing for shaping so that the metal phase comprised mainly of Cu present in the processed part has a number density of 20 /$\mu m^3$ or more.

(12) A processed part of a high strength electrical steel sheet as set forth in any one of (1) to (7) and (11), characterized wherein the part is heat treated after processing for shaping so that the metal phase comprised mainly of Cu present in the part has an average size of 0.1 μm or less.

(13) A processed part of a high strength electrical steel sheet as set forth in any one of (1) to (7) and (11) and (12), characterized wherein the part is heat treated after processing for shaping so that the part has an average crystal grains size of 3 to 300 μm.

(14) A processed part of a high strength electrical steel sheet as set forth in any one of (1) to (7) and (11) to (13), characterized wherein the part is heat treated after processing for shaping so that the number density of the metal phase comprised mainly of Cu with a size of 0.1 μm or less in the processed part is increased by 10-fold or more.

(15) A processed part of a high strength electrical steel sheet as set forth in any one of (1) to (7) and (11) to (14), wherein the part is heat treated after processing for shaping so that the tensile strength is increased by 30 MPa or more.

(16) A processed part of a high strength electrical steel sheet as set forth in any one of (1) to (7) and (11) to (15), wherein the part is heat treated after processing for shaping so that the hardness is increased by 1.1-fold or more.

(17) A method of production of a high strength electrical steel sheet as set forth in any one of (11) to (16), characterized by making the residence time in the temperature range of 450° C. to 700° C. in the cooling process from a temperature range of 750° C. or more after the hot rolling process before cold rolling 300 seconds or less, then cold rolling without holding in a temperature range over 750° C. so as to keep the steel soft before processing for shaping and harden it by heat treatment after the processing for shaping.

(18) A method of production of a high strength electrical steel sheet as set forth in (17), characterized by holding at 750° C. or more in a final heat treatment process after hot rolling and cold rolling, then making the residence time in the temperature range of 450° C. to 700° C. in the cooling process from the temperature range of 750° C. or more 60 seconds or less, then not holding in a temperature range over 750° C. so as to keep the steel soft before processing for shaping and harden it by heat treatment after the processing for shaping.

(19) A method of production of a processed part of a high strength electrical steel sheet characterized by processing for shaping the electrical steel sheet as set forth in any of (1) to (7) and (11) to (16) or an electrical steel sheet produced by a method as set forth in any of (17) and (18), then holding in a temperature range of 300° C. to 720° C. for 5 seconds or more, then not holding in a temperature range over 700° C. for 20 seconds or more to obtain the processed part.

(20) A method of production of a processed part of a high strength electrical steel sheet as set forth in (19), characterized by, as said heat treatment method, making an average cooling rate of a cooling process from the heat treatment temperature to 700° C. in heat treatment after processing the steel sheet to an electrical part 10° C./seconds or more, holding in a temperature range of 300° C. to 720° C. for 5 seconds or more, then not holding in a temperature range over 700° C. for 20 seconds or more.

BEST MODE FOR WORKING THE INVENTION

Figure 1:
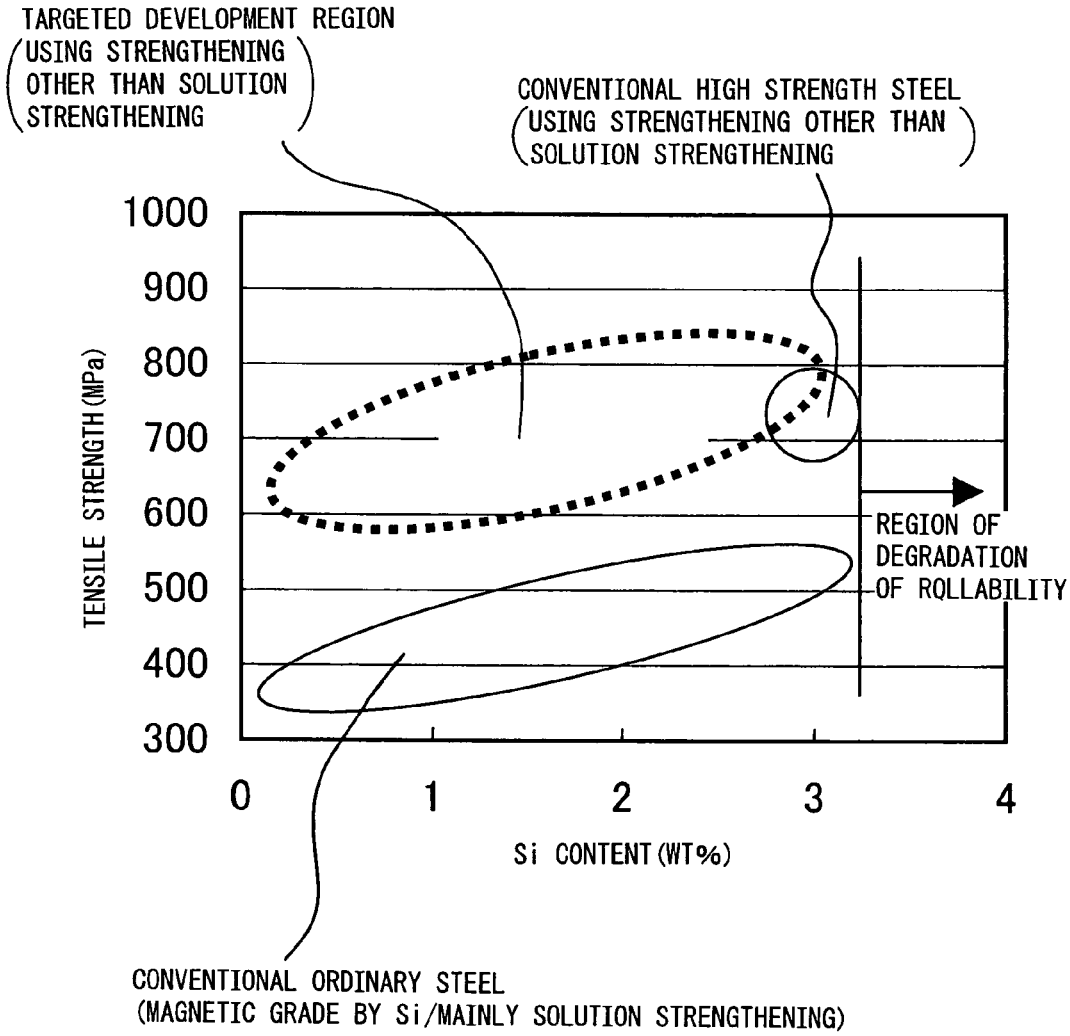
FIG. 1 is a schematic drawing of the relationship between the Si content and tensile strength of the electrical steel sheet of the present invention.

First, the composition of the high strength electrical steel sheet according to the present invention will be described in detail.

Carbon degrades magnetic properties of the sheet and the amount is 0.06% or less. Carbon is effective from the viewpoint of increasing the strength, in particular raising the yield stress, improving the strength in hot condition and creep strength, and improving the fatigue properties in hot condition. It is also effective in improving the texture by suppressing the development of {111} orientation not desirable for magnetic properties and accelerating development in the preferable {110}, {100}, {114} etc. From this viewpoint, the amount is preferably 0.04% or less, more preferably 0.0031 to 0.0301%, more preferably 0.0051 to 0.0221%, more preferably 0.0071 to 0.0181%, more preferably 0.0081 to 0.0151%. If within the range of the present invention, it is possible to suppress the magnetic aging by using gradual cooling, holding at a low temperature, or other heat histories to an extent not so much problem.

On the other hand, when the requirements regarding magnetic aging are extremely severe, it is possible to include a higher amount of C up to the slab production stage from the viewpoint of the deoxidation efficiency and to reduce the C to 0.0040% or less by decarburizing annealing after being made into a coil. In this case, from the viewpoint of production costs, it is advantageous to reduce the amount of C by a degasification facility at the molten steel stage. If 0.0020% or less, there is a remarkable effect of suppression of magnetic aging. To increase the strength, when not using carbides or other nonmetal precipitates, C content is preferably 0.0015% or less, and more preferably 0.0010% or less.

Silicon increases volume resistivity of the steel reducing the eddy current to reduce the core loss and increases the tensile strength, but if the amount added is less than 0.2%, that effect is small. Increasing the Si content degrades less magnetic properties and in particular it is possible to reduce the core loss and to increase the strength, so Si content is preferably in an amount of 1.0% or more, more preferably 2.0% or more, in the steel. On the other hand, if Si is over 6.5%, the steel is embrittled and further the magnetic flux density of the product sheet is degraded, so the amount is 6.5% or less, preferably 3.5% or less. To further reduce the concern over the brittleness, 3.2% or less Si is preferable. If Si is 2.8% or less, there is no longer a need to consider the brittleness although it is related with the amounts of other elements.

Manganese may be purposely added to improve the steel in strength, but is not particularly required for this purpose in the steel of the present invention utilizing a fine metal phase as the main means for increasing the strength. This is added to for the purpose of increasing the volume resistivity or coarsening the sulfides to promote crystal grain growth reducing the core loss, but since excessive addition reduces the magnetic flux density, the amount is 0.05 to 3.0%. Preferably, the amount is 0.5% to 1.2%.

Phosphorus is an element with a remarkable effect of improving the tensile strength, but like with the above mentioned Mn, in the steel of the present invention, the addition is not necessary. If P amount is over 0.30%, it causes so severe brittleness that hot rolling, cold rolling, or other processing in an industrial scale is difficult, so the upper limit of P is 0.30%.

Sulfur easily combines with Cu, the essential element in the steel of the present invention, to form a Cu sulfides and thereby has an adverse effect on the formation of the metal phase mainly composed of Cu which is important in the present invention resulting in degrading the strengthening efficiency in some cases, so care is required when including it in large amounts. Further, depending on the heat treatment conditions, it is also possible to purposely form fine Cu sulfides and promote an increase in strength. Thus produced sulfides sometimes degrades the magnetic properties, in particular the core loss. In particular, in the case of non-oriented electrical steel sheet, a low S content is preferable, so Cu content is limited to 0.040% or less. Preferably, it is 0.020% or less, more preferably 0.010% or less. Selenium also has substantially the same effect as S.

Aluminum is usually added as a deoxidizing agent although it is also possible to add less Al and use Si for deoxidization. In particular, in the case of a non-oriented electrical steel sheet, AlN is not formed in Si-deoxidized steel with an Al content of about 0.005% or less, so there is also the effect of reducing the core loss. On the other hand, it is possible to purposely add it to promote coarsening AlN and increase the volume resistivity to reduce the core loss. However, if Al content is over 2.50%, embrittlement becomes a problem, thus the content is 2.50% or less.

Cu is an essential element in the present invention. The range for forming a metal phase mainly composed of Cu in the steel sheet to increase the strength not having a adverse effect on the magnetic properties is limited to 0.6 to 8.0%. More preferably, it is 0.8 to 6.0%. If the Cu is low in content, the effect of increasing the strength becomes small, the heat treatment conditions for obtaining the effect of increasing strength are limited to a narrow range, and the flexibility of control of the production conditions and adjustment of production becomes smaller. Further, if the Cu is high in content, the effect on the magnetic properties becomes larger resulting in remarkably increased core loss, and increased cracking or flaws in the steel sheet at the time of hot rolling.

In particular, an amount of Cu over the limit of solid solution in the steel contributes to increased strength as solute Cu, but the strengthening efficiency becomes poor compared with the Cu metal phase of the main object of the present invention. Further, excessive Cu forms a metal phase in the steel in a not preferable process depending on the heat history. For example, Cu forms a relatively coarse Cu metal phase in a high temperature such as during hot rolling, which acts unpreferably on the formation of the subsequent fine metal phase or has a detrimental effect on the magnetic properties in some cases. The particularly preferable range of Cu is 1.0 to 5.0%. More preferably, it is 1.5 to 4.0%, more preferably 2.0 to 3.5%.

Nitrogen, like C, degrades the magnetic properties, and thus the amount is 0.0400% or less.

In Si-deoxidized steel with Al of about 0.005% or less, like C, it is an element effective from the viewpoint of improving the texture in addition to increasing the strength, in particular increasing the yield stress, increasing the high temperature strength and creep strength, and increasing the fatigue properties. From this viewpoint, it is preferably 0.0031 to 0.0301%, more preferably 0.0051 to 0.0221%, more preferably 0.0071 to 0.0181%, more preferably 0.0081 to 0.0151%. However, when Al is about 0.010% or more, if a large amount of N is included, fine AlN is formed and the magnetic properties are remarkably degraded, so this must be avoided.

In Al-deoxidized steel, N content should be 0.0040% or less. In the present invention where no strengthening due to nitrides is expected, the lower the better. If N is 0.0027% or less, there is a remarkable effect of suppression of magnetic aging or degradation of properties due to AlN in the Al-containing steel. Therefore, N is more preferably 0.0022%, more preferably 0.0015% or less.

Almost all elements utilized in the past for increasing the strength in high strength electrical steel sheet not only are problematic in terms of the cost of addition, but also have some detrimental effect on the magnetic properties, so, in the present invention, they do not really have to be added for the purpose of increasing the strength. When they are purposely added as strengthening elements, due to the relation with rising costs and degradation of magnetic properties, one type or more of Nb, Ti, B, Ni, and Cr may be added but the amounts added are Nb: 8% or less, preferably 0.02% or less, Ti: 1.0% or less, preferably 0.010% or less, B: 0.010% or less, Ni: 5.0% or less, and Cr: 15% or less, preferably 10.0% or less.

In particular, Ni is known to be effective to prevent surface roughening by Cu, the essential element in the steel of the present invention, at hot rolling (Cu scab) and may be purposely added for this purpose as well. Boron segregates at the crystal grain boundaries and has the effect of suppressing embrittlement due to grain boundary segregation of P, but in the steel of the present invention, embrittlement does not become a particular problem like in the conventional mainly solution strengthened high strength electrical steel sheet, so addition for this purposes is not important. Rather, it may be added for the purpose of improving the magnetic flux density due to the effect of the solute B on the texture. If B is over 0.010%, remarkable embrittlement results, so the upper limit of B is 0.010%.

Niobium and Titanium form fine precipitates of carbides, nitrides, or sulfides in the steel sheet and are elements effective for increasing the strength, but simultaneously cause remarkable degradation of the magnetic properties, in particular the core loss. In the steel of the present invention not utilizing fine carbides, nitrides, etc. as main means for increasing the strength, these are rather harmful elements. For this reason, the upper limit for Nb is 8% or less, preferably 0.02% or less, while that for Ti is 1.0% or less, preferably 0.010%. With both, the limit is more preferably 0.0050% or less, and further preferably 0.0030% or less, whereby it is possible to obtain a good core loss.

Nickel is known to be effective for the prevention of surface roughening at hot rolling due to Cu (Cu scab), the essential element in the steel of the present invention, and can be purposely added together with this purpose. Further, it has a relatively small detrimental effect on the magnetic properties and is deemed effective for increasing the strength as well, so is an element often used in high strength electrical steel sheet. For the purpose of preventing Cu roughening, it is added in an amount of roughly about ⅛ to ½ of the amount of Cu. Further, in the steel of the present invention increased in strength utilizing the Cu metal phase, by including Ni as well, the dispersion of the metal Cu phase also becomes extremely preferable for suppressing degradation of the magnetic properties and increasing the strength. The reason for this is not clear, but is expected to be for example the effect of the solid solution of the Ni in the metal Cu phase or the formation of a metal phase related with Ni and Cu. Further, it is also effective for improvement of the corrosion resistance, but considering the cost of addition and the detrimental effects on the magnetic properties, the upper limit is preferably 5% and further preferably 2.5%.

Chromium is an element added to improve the corrosion resistance or to improve the magnetic properties in high frequency, but again considering the cost of addition and the detrimental effects on the magnetic properties, preferably the upper limit is 15% and more particularly 10.0%.

Further, regarding the other minor elements, not only the amounts unavoidably contained due to the ore, scrap, etc., but the amounts added for various purposes do not impair the effects of the present invention in any way. The unavoidable contents of these elements are usually about 0.005% or less each, but addition in amounts of 0.01% or more is possible for various purposes. In this case as well, considering the balance of the cost and magnetic properties, the steel may contain one or more of Bi, Mo, W, Sn, Sb, Mg, Ca, Ce, La, Co, and other rare earth elements in a total of 0.5% or less.

The steel containing these compositions is produced in the same way as an conventional electrical steel sheet wherein it is melted in a converter, continuously cast into a slab, hot rolled, hot band annealed, cold rolled, final annealed and so on. In addition to these processes, formation of an insulating film or a decarburization process etc. do not impair the effect of the present invention in any way. Further, unusual process such as production of thin strip by rapid solidification or continuous casting of thin slabs omitting the hot rolling process have no problems.

To form the specific metal phase characteristic of the present invention in the steel sheet, it is effective to go through the following heat history. In the process of production of a product sheet, the sheet is held at a temperature range of 300° C. to 720° C. for 5 seconds or more. The temperature range is preferably 300 to 650° C., more preferably 350 to 600° C., more preferably 400 to 550° C., more preferably 420 to 500° C. The holding time is related to the holding temperature. Preferably, the lower the temperature, the longer the time. On the other hand, holding at a high temperature for a long time is not preferable. Preferably, it is 650° C. or so for 1 minute to 5 hours, at 550° C. or so for 3 minutes to 20 hours, and at 450° C. or so for 10 minutes or more.

Further, after this heat treatment, it is preferable to avoid a process holding the heat treated steel sheet at a temperature range over 800° C. for 20 seconds or more.

Through the above process, a Cu metal phase of characteristic composition, size, and number density is efficiently formed, the magnetic properties are not impaired much at all, and the strength can be increased. On the other hand, through ordinary heat treatment conditions not aiming at formation of such a metal phase, the majority of the Cu added forms solute Cu or Cu sulfides which are low in strengthening ability and large in effect of degradation of magnetic properties or a relatively coarse Cu metal phase which is small in strengthening ability and large in detrimental effect on the magnetic properties although it is a Cu metal phase.

After this heat treatment process, the steel is increased in strength, so performing this heat treatment process after the rolling process and performing it simultaneously with the recrystallization annealing or other heat treatment required for other purposes is advantageous from the viewpoint of productivity. That is, holding in the temperature range of 300° C. to 720° C. for 5 seconds or more in the final heat treatment process after the cold rolling in the case of cold rolled electrical steel sheet or in the cooling process from the temperature range of 750° C. or more in the final heat treatment process after hot rolling in the case of hot rolled electrical steel sheet is preferable. The effect of this heat treatment depends on the steel components, in particular the amounts of Cu, Ni, etc., but some sort of effect may occur even with a heat history of a cooling rate of such as air cooling after recrystallization annealing.

Further, depending on the targeted properties etc., heat treatment is sometimes further added, but in this case, it is preferable not to hold the steel in a temperature range over 800° C. for 20 seconds or more. When the temperature and time exceed this in the heat treatment, the formed Cu metal phase resolidifies or conversely aggregates to form a coarse metal phase in some cases. In particular, when the metal phase becomes coarsened, the core loss remarkably deteriorates.

Since the present invention does not utilize strengthening by refinement of crystal structure, there is little degradation of the strength even if performing SRA (stress relief annealing) for relieving the stress introduced into the material and growing the crystal grains to restore and improve the magnetic properties when stamping steel sheet and processing it to motor parts etc. or some other heat treatment performed for other purposes.

Further, it is important that the specific metal phase characteristic of the present invention go through the following heat history for formation in the steel sheet after processing to an electrical part. This is to control the holding time in the 300° C. to 720° C. temperature range and the subsequent heat history in the process of producing the product sheet and the heat treatment process after being processed to an electrical part.

That is, as the heat treatment given to the steel sheet up until the final processing, i.e. punching and fabricating process for utilizing the electrical steel sheet as an electrical part, it is preferable to make the residence time in the temperature range of 450° C. to 700° C. in the cooling process from the temperature range of 750° C. or more to 300 seconds or less for the heat history before the cold rolling after the final hot rolling and 60 seconds or less for the annealing process after cold rolling respectively, and then not holding at a temperature range over 750° C.

Further, the hardening is performed after the final processing of the electrical steel sheet, i.e. the punching and fabricating process for utilization of the electrical steel sheet for an electrical part. It can be achieved by a heat treatment comprising holding the steel at a temperature range of 300° C. to 720° C. for 5 seconds or more, then not holding at a temperature range over 700° C. for 20 seconds or more. When this heat treatment is performed in the cooling process after a heat treatment at a higher temperature, the average cooling rate of the cooling process down to 700° C. before holding in the temperature range of 450° C. to 700° C. is preferably 10° C./second or more, more preferably the average cooling rate of the cooling process down to 650° C. before holding in the temperature range of 500° C. to 650° C. is 10° C./second or more. Performing this heat treatment in the cooling process such as so-called stress relief annealing process performed for the purpose of relieving the stress introduced against intent in the material when processing, or the heat treatment for burning off the oil adhering to the steel sheet at processing is preferable from the viewpoint of the productivity. The maximum peak temperature of 700° C. or more before holding in the temperature range of 300° C. to 720° C. and the holding time in that temperature range can be determined from only the viewpoint of stress relief and crystal grain growth and do not have any influence on the effects of the present invention.

The holding temperature range in the temperature range of 300° C. to 720° C. for hardening is preferably 300 to 650° C., more preferably 350 to 600° C., further preferably 400 to 550° C., and further preferably 420 to 500° C. The holding time is related to the holding temperature. It is preferable that the lower the temperature, the longer the time. On the other hand, holding at a high temperature for a long time is not preferable. Preferably, if holding at around 650° C. for 1 minute to 5 hours, at around 550° C. for 3 minutes to 20 hours, and at 450° C. or so for 10 minutes or more, a sufficient hardening effect can be obtained.

Passing through this process results in efficient formation of the metal phase characteristic in composition, size, and number density in a preferable process and enables hardening without impairing the magnetic properties much at all. According to the present invention, the steel can be increased in tensile strength by 30 MPa or more or in hardness by 10% or more by heat treatment for hardening. If the increment in strength or hardness is less than this, probably the steel is already hardened before the heat treatment or the strengthening ability by heat treatment is originally not provided.

If the sheet is already hardened before heat treatment, punching into the motor part etc. is performed on a hard material, which is not preferable from the viewpoint of the wear of the dies. Further, when not hardened even with heat treatment, the strength during use as a motor becomes insufficient and the object of the present invention is not achieved. To obtain a more preferable effect, preferably the increase in tensile strength due to the heat treatment is 60 MPa or more and the increase in hardness is 20% or more, more preferably the increase in tensile strength is 100 MPa or more and the increase in hardness is 30% or more, further preferably the increase in tensile strength is 150 MPa or more and the increase in hardness is 40% or more, and further preferably the increase in tensile strength is 200 MPa or more and the increase in hardness is 50% or more.

On the other hand, when passing through normal heat treatment conditions not aiming at formation of a metal phase as controlled in the present invention, depending on the steel composition, sometimes the effect of the formation of a metal phase may be detected, but the majority of the added Cu is present as solute Cu or Cu sulfides or a coarse metal phase over a size of 0.1 μm which are low in strengthening ability and large in effect of degradation of the magnetic properties.

The metal phase formed in the above way is mainly comprised of Cu. This can be identified by the diffraction parameters of an electron microscope etc. or an attached X-ray analysis apparatus etc. Of course, it may also be identified by chemical analysis or another method. In the present invention, this metal phase mainly comprised of Cu has a size 0.1 μm or less, more preferably 0.01 μm or less. If the size is more than this, the efficiency of increasing the strength falls. In this condition, not only a large amount of metal phase becomes necessary, but also the detrimental effect on the magnetic properties becomes greater. From the viewpoint of increasing the strength and the magnetic properties, the diameter is preferably 0.008 μm or less, further 0.005 μm or less, and more preferably 0.002 μm or less. Note that if less than 0.001 μm, the size becomes too fine and quantification of the metal phase size and amount of metal phase would become difficult even by the current highest precision analysis equipment, but identification by X-ray analysis equipment and indirect explanation of presence by mechanical properties, hardness, etc. would be possible. The present invention is limited to an electrical steel sheet which contains a considerable amount of Cu and clearly hardens by appropriate heat treatment explained in the present invention. Needless to say, while the present invention describes a "Cu metal phase", this does not limit its form or type.

The number density of the Cu metal phase is limited in the possible range in the relation between the Cu content and size of the metal phase, but preferably is 0.2 /$\mu m^3$ or more, 1 /$\mu m^3$ or more, 5 $\mu m^3$ or more, more preferably 20 /$\mu m^3$ or more, more preferably 50 $\mu m^3$ or more, 100 /$\mu m^3$ or more, or 200 $\mu m^3$ or more, more preferably 500 $\mu m^3$ or more, 1,000 /$\mu m^3$ or more, 2,000 /$\mu m^3$ or more. If so, this is extremely effective in the point of increasing the strength. More preferably, it is 5,000 /$\mu m^3$ or more, 10,000 /$\mu m^3$ or more, 20,000 /$\mu m^3$, more preferably 200,000 /$\mu m^3$, more preferably 2,000,000 /$\mu m^3$.

Control of the metal phase size and number density is extremely important from the viewpoint of achieving both increased strength and holding the magnetic properties. The reason is that these are not only effective on the strength and magnetic properties, but also the way of change of strength and magnetic properties differs when these are changed. That is, it is necessary to control these to the range where the effect of increasing the strength is high and the efficiency of degradation of the magnetic properties is low. For this reason, it is effective to suitably control the temperature and time in the above-mentioned temperature range of 300 to 720° C. and the cooling rate immediately before entering this temperature range. The effect is, under normal conditions, like as the formation of general precipitates, if the cooling rate is higher and the temperature is lower, the precipitates are finer and the metal phase density is higher. A long time leads to a coarser size.

Further, in the present invention, since refinement of the crystal structure is not utilized as the main means for increasing the strength, the crystal grain size can be adjusted to the optimal range from the viewpoint of the magnetic properties. The size and density of the metal phase mainly comprised of Cu contributing to the increased strength can be controlled not only by the components, but also mainly by the above-mentioned heat treatment at 720° C. or less, so the crystal grain size can be independently controlled from the strength by for example the maximum peak temperature of the recrystallization annealing and the holding time in this temperature range before the heat treatment. Normally, it is controlled to 3 μm to 300 μm by heat treatment at 800° C. to 1100° C. or so for 20 seconds to 5 minutes or so. More preferably, it is 8 μm to 200 μm. In general, when the frequency of the magnetization current at the time of use of the steel sheet is high, the crystal grains are preferably fine.

Figure 2:
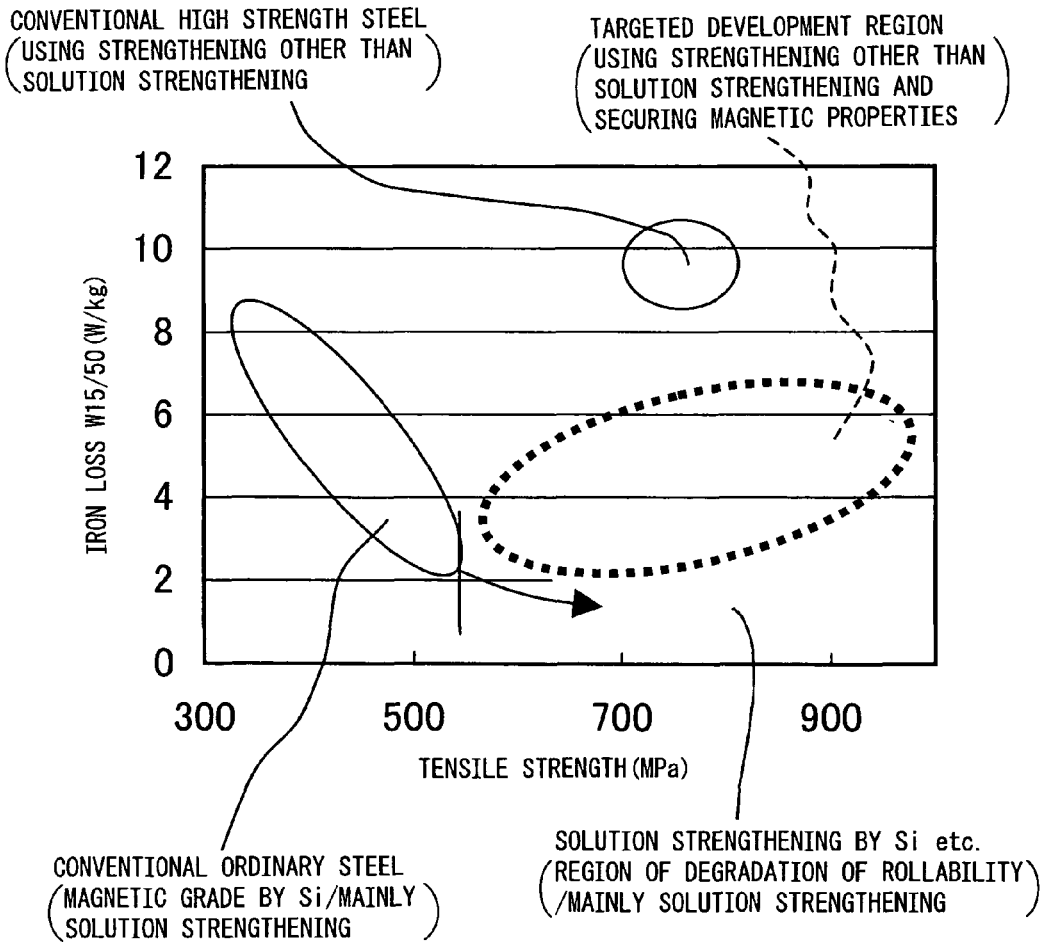
FIG. 2 is a schematic drawing of the relationship between the tensile strength and core loss of the present invention.

The present invention has properties completely different from the materials developed in the past for magnetic steel sheet. FIGS. 1 and 2 show the characteristics of the present invention from the viewpoint of the compositions, strength, and magnetic properties of the electrical steel sheet. As shown in FIG. 1, usually electrical steel sheet is produced selectively for magnetic properties mainly by the Si content. From the viewpoint of the magnetic properties, Si is usually added to increase the electrical resistance of the material and to reduce the core loss, but since Si also has a strong solid solution strengthening effect, the strength is also increased in high Si, i.e. high grade, materials. However, if the amount of Si is over 3% or the combination of Si, Al, Mn and other strengthening elements exceeds 6.5%, the rollability remarkably degrades and production of the steel sheet becomes difficult in conventional production process.

As the means for avoiding rolling, the method of directly obtaining a thin film from molten state steel by rapid solidification has been proposed, but there are limits to practical use of this from the viewpoint of cost and properties. For this reason, a high strength material equivalent to 3% Si steel or more is strengthened by the precipitates mainly comprised of carbonitrides accompanying addition of Nb etc. and the refinement of the crystal structure also involving low temperature annealing. However, such carbonitrides or a fine crystal structure is not preferable from the viewpoint of the magnetic properties, in particular the core loss as shown in FIG. 2, wherein a great increase in the core loss is unavoidable. In this invention, however, in so far as the magnetic properties are not remarkably impaired, the steel sheet of the present invention may contain these carbonitrides or may have a residual deformation texture in part. In other words, it is possible to use the effect of hardening by the Cu metal phase according to the present invention in combination with the conventional high strength steel using carbonitrides or high strength steel using the deformation texture so as to further increase the strength. In particular, the steel of the present invention containing high amount of Cu may leave a residual deformation texture under low temperature annealing conditions because of high recrystallization temperature depending on the components or heat history.

The present invention disperses a metal phase in a steel sheet so as to increase the strength, which is different from the conventional high strength steels. This metal phase can be controlled independently of the crystal grain size, that is, formation of the metal phase can be controlled in a lower temperature range of about 300 to 720° C. which is different from the temperature range where crystal grain growth occurs, that is, about 750° C. or more. Therefore the present invention has a greater flexibility from the viewpoint of controlling the strength and magnetic properties independently and thus, as shown in FIG. 2, the strength can be increased without degrading the magnetic properties very much.

Further, as shown in FIG. 1, by applying this technology to low Si steel, it becomes possible to obtain a material with a higher magnetic flux density than conventional one. This is considered to be as follows: because most of the solid solution strengthening elements including typically used Si, Al, Mn reduce the saturation magnetic flux density of the steel, lowered magnetic flux density in a specific magnetic field is unavoidable, but in the present invention, the Cu metal phase used for increasing the strength has an extremely small effect in reducing the saturation magnetic flux density. Furthermore, it is considered that the Cu metal phase does not become a barrier for magnetic domain wall motion compared with other precipitates such as carbonitrides. This is effective for improvement of the magnetic properties especially in a low magnetic field.

Note that the effects of the present invention are not affected by the existence and type of surface coating normally formed on the surface of the electrical steel sheet or by the production process, so that it can be applied to non-oriented or grain-oriented electrical steel sheet.

The applications are also not particularly limited. The sheet can be applied not only to the rotors of motors used in home electric appliances or automobiles etc., but also to all other applications where both strength and magnetic properties are required.

EXAMPLES

Example 1

The steel compositions shown in Table 1 was made into a 250 mm thick slaband final sheets were produced by basically following process. The basic process conditions were a slab heating temperature of 1100° C., a final hot band thickness of 2.0 mm, a coiling temperature of 500° C. in hot rolling, a final sheet thickness of 0.5 mm in the cold rolling, and a recrystallization annealing temperature of 850° C. Each product sheet was measured for mechanical properties using a JIS No. 5 test piece and for magnetic flux density $B_{10}$ and core loss $W_{10/400}$ using a 55 mm square SST test. The mechanical properties and magnetic properties were calculated as the average of the values of the rolling direction and transverse direction of the coil. The results are shown in Table 2 (continuation of Table 1).

As clear from the results shown in Table 2, the samples produced by the conditions of the present invention are good in rollability at the cold rolling process, hard, and superior in magnetic properties.

TABLE 1

| | Steel compositions (mass %) | | | | | | | | | Precipitation process | | High temperature treatment after precipitation | |
|---|---|---|---|---|---|---|---|---|---|---|---|---|---|
| No. | C | Si | Mn | P | S | Al | N | Cu | Others | Temperature (° C.) | Holding time (min) | Temperature (° C.) | Holding time (sec) |
| 1 | 0.0020 | 1.1 | 0.32 | 0.021 | 0.0030 | 0.002 | 0.0024 | 0.006* | — | — | — | — | — |
| 2 | 0.0049 | 1.1 | 0.33 | 0.121 | 0.0023 | 0.003 | 0.0039 | 0.007* | Ni: 1.5<br>Nb: 0.03 | — | — | — | — |
| 3 | 0.0008 | 1.2 | 0.13 | 0.016 | 0.0023 | 0.001 | 0.0023 | 0.93 | — | 650 | 60 | — | — |

TABLE 1-continued

| | Steel compositions (mass %) | | | | | | | | | Precipitation process | | High temperature treatment after precipitation | |
|---|---|---|---|---|---|---|---|---|---|---|---|---|---|
| No. | C | Si | Mn | P | S | Al | N | Cu | Others | Temperature (° C.) | Holding time (min) | Temperature (° C.) | Holding time (sec) |
| 4 | 0.0015 | 1.3 | 0.32 | 0.015 | 0.0010 | 0.002 | 0.0017 | 1.41 | — | 700 | 120 | — | — |
| 5 | 0.0016 | 1.1 | 0.30 | 0.020 | 0.0026 | 0.005 | 0.0015 | 1.14 | — | 550 | 10 | — | — |
| 6 | 0.0022 | 1.2 | 0.44 | 0.021 | 0.0260 | 0.002 | 0.0014 | 1.40 | Ni: 1.3 | 500 | 60 | — | — |
| 7 | 0.0022 | 1.2 | 0.44 | 0.021 | 0.0260 | 0.002 | 0.0059 | 1.40 | Ni: 1.3 | 500 | 60 | — | — |
| 8 | 0.0022 | 1.2 | 0.44 | 0.021 | 0.0260 | 0.002 | 0.0165 | 1.40 | Ni: 1.3 | 500 | 60 | — | — |
| 9 | 0.0022 | 1.2 | 0.44 | 0.021 | 0.0053 | 0.002 | 0.0014 | 1.83 | Ti: 0.03 | 450 | 120 | — | — |
| 10 | 0.0022 | 1.2 | 0.44 | 0.021 | 0.0021 | 0.002 | 0.0014 | 2.41 | — | 400 | 150 | — | — |
| 11 | 0.0022 | 1.2 | 0.44 | 0.021 | 0.0021 | 0.002 | 0.0105 | 2.41 | — | 400 | 150 | — | — |
| 12 | 0.0022 | 1.2 | 0.44 | 0.021 | 0.0021 | 0.002 | 0.0211 | 2.41 | — | 400 | 150 | — | — |
| 13 | 0.0027 | 1.1 | 0.80 | 0.020 | 0.0005 | 0.003 | 0.0020 | 2.74 | — | 300 | 1000 | — | — |
| 14 | 0.0091 | 1.1 | 0.80 | 0.020 | 0.0005 | 0.003 | 0.0020 | 2.74 | — | 300 | 1000 | — | — |
| 15 | 0.0018 | 1.3 | 0.30 | 0.016 | 0.0013 | 0.002 | 0.0022 | 8.53* | — | 500 | 120 | — | — |

*Constitutions outside range of claims of present invention

TABLE 2

| | Metal phase composed of Cu | | Crystal grain | Mechanical properties | | | | Magnetic properties | | Cold | |
|---|---|---|---|---|---|---|---|---|---|---|---|
| No. | Average size (μm) | Number density (/μm$^3$) | average size (μm) | Hardness Hv | YP (MPa) | TS (MPa) | EI (%) | $B_{10}$ (T) | $W_{10/400}$ (W/kg) | roll-ability | Evalua-tion |
| 1 | — | — | 100 | 140 | 276 | 475 | 35 | 1.63 | 35.0 | VG | D |
| 2 | — | — | 25 | 240 | 518 | 682 | 14 | 1.30 | 52.9 | F | D |
| 3 | 0.35* | 0.2 | 120 | 216 | 448 | 573 | 32 | 1.62 | 37.3 | VG | D |
| 4 | 0.22* | 2.5 | 160 | 250 | 533 | 623 | 25 | 1.60 | 34.8 | VG | D |
| 5 | 0.008 | 30 | 180 | 245 | 545 | 690 | 28 | 1.60 | 32.5 | VG | C |
| 6 | 0.005 | 200 | 90 | 265 | 588 | 756 | 19 | 1.62 | 34.1 | VG | B |
| 7 | 0.005 | 200 | 90 | 270 | 622 | 765 | 17 | 1.64 | 33.1 | VG | B |
| 8 | 0.005 | 200 | 85 | 276 | 673 | 769 | 14 | 1.64 | 33.5 | VG | B |
| 9 | 0.002 | 2000 | 70 | 288 | 576 | 699 | 25 | 1.58 | 36.1 | VG | B |
| 10 | 0.001 | 400 | 120 | 276 | 622 | 789 | 26 | 1.60 | 29.7 | VG | A |
| 11 | 0.001 | 400 | 115 | 298 | 725 | 792 | 20 | 1.63 | 30.1 | VG | A |
| 12 | 0.001 | 400 | 120 | 302 | 755 | 815 | 22 | 1.61 | 27.6 | VG | A |
| 13 | 0.001 | >10000 | 100 | 310 | 788 | 923 | 20 | 1.57 | 37.2 | VG | A |
| 14 | 0.001 | >10000 | 100 | 325 | 882 | 944 | 15 | 1.59 | 35.9 | VG | A |
| 15 | 0.35* | 2.3 | 70 | 249 | 547 | 704 | 25 | 1.40 | 48.8 | G | D |

Evalulation
A: Developed steel (very good)
B: Developed steel (good)
C: Developed steel (slightly good)
D: Comparative steel
Cold rollability
VG: Very good (no problem at all)
G: Good (fine adjustment required, but no problem)
F: Fair (sheet runnable if adjusting conditions)
P: Poor (large danger of sheet breakage)

Example 2

The steel compositions shown in Table 3 was made into a 250 mm thick slab and final sheets were produced by basically following process. The basic process conditions were a slab heating temperature of 1100° C., a final hot band thickness of 2.0 mm, a coiling temperature of 700° C. in the hot rolling, a hot band annealing of 980° C. temperature for 30 seconds, a final sheet thickness of 0.2 mm in the cold rolling, and a recrystallization annealing of 1000° C. Each product sheet was measured for mechanical properties using a JIS No. 5 test piece and for magnetic flux density $B_{50}$ and core loss $W_{15/50}$ using a 55 mm square SST test. The mechanical properties and magnetic properties were calculated as the average of the values of the rolling direction and transverse direction of the coil. The results are shown in Table 4 (continuation of Table 3).

As clear from the results shown in Table 4, the samples produced by the conditions of the present invention are good in rollability at the cold rolling process, hard, and superior in magnetic properties.

TABLE 3

| | Steel compositions (mass %) | | | | | | | | | Precipitation process | | High temperature treatment after precipitation | |
|---|---|---|---|---|---|---|---|---|---|---|---|---|---|
| No. | C | Si | Mn | P | S | Al | N | Cu | Other | Temperature (° C.) | Holding time (min) | Temperature (° C.) | Holding time (sec) |
| 16 | 0.0021 | 3.1 | 0.18 | 0.014 | 0.0005 | 0.51 | 0.0018 | 0.008* | — | — | — | — | — |
| 17 | 0.0088 | 3.1 | 0.20 | 0.014 | 0.0017 | 0.56 | 0.0012 | 0.026* | Ni: 2.5 Nb: 0.03 | — | — | — | — |
| 18 | 0.0009 | 2.8 | 0.19 | 0.005 | 0.0024 | 0.57 | 0.0011 | 0.97 | — | 750 | 120 | — | — |
| 19 | 0.0021 | 3.1 | 0.20 | 0.007 | 0.0012 | 0.52 | 0.0006 | 1.37 | — | 700 | 0.5 | — | — |
| 20 | 0.0021 | 3.1 | 0.21 | 0.005 | 0.0049 | 0.54 | 0.0011 | 1.66 | — | 600 | 2 | — | — |
| 21 | 0.0011 | 2.9 | 0.19 | 0.014 | 0.0068 | 0.56 | 0.0008 | 1.52 | Cr: 4.5 | 500 | 5 | 1050 | 30 |
| 22 | 0.0021 | 2.5 | 0.16 | 0.004 | 0.0023 | 0.52 | 0.0023 | 3.31 | — | 450 | 120 | — | — |
| 23 | 0.0051 | 2.5 | 0.16 | 0.004 | 0.0023 | 0.52 | 0.0023 | 3.31 | — | 450 | 120 | — | — |
| 24 | 0.0112 | 2.5 | 0.16 | 0.004 | 0.0023 | 0.52 | 0.0023 | 3.31 | — | 450 | 120 | — | — |
| 25 | 0.0145 | 2.5 | 0.16 | 0.004 | 0.0023 | 0.52 | 0.0023 | 3.31 | — | 450 | 120 | — | — |
| 26 | 0.0205 | 2.5 | 0.16 | 0.004 | 0.0023 | 0.52 | 0.0023 | 3.31 | — | 450 | 120 | — | — |
| 27 | 0.0013 | 3.1 | 0.24 | 0.012 | 0.0130 | 0.88 | 0.0010 | 2.85 | Ni: 1.4 | 400 | 600 | — | — |
| 28 | 0.0255 | 3.1 | 0.24 | 0.012 | 0.0130 | 0.88 | 0.0010 | 2.85 | Ni: 1.4 | 400 | 600 | — | — |
| 29 | 0.0009 | 2.8 | 0.21 | 0.008 | 0.0012 | 0.55 | 0.0013 | 5.12 | Ni: 2.0 | 350 | 1800 | 1000 | 40 |
| 30 | 0.0015 | 3.1 | 0.18 | 0.009 | 0.0023 | 0.55 | 0.0011 | 8.72* | — | 450 | 120 | — | — |

*Constitution outside range of claims of present invention

TABLE 4

| | Metal phase composed of Cu | | Crystal grain | Mechanical properties | | | | Magnetic properties | | Cold | |
|---|---|---|---|---|---|---|---|---|---|---|---|
| No. | Average size (μm) | Number density (/μm$^3$) | average size (μm) | Hardness Hv | YP (MPa) | TS (MPa) | EI (%) | $B_{50}$ (T) | $W_{15/50}$ (W/kg) | roll-ability | Evaluation |
| 16 | — | — | 120 | 176 | 390 | 530 | 17 | 1.68 | 2.4 | F | D |
| 17 | — | — | 20 | 320 | 804 | 833 | 14 | 1.64 | 10.6 | P | D |
| 18 | 0.55* | 0.2 | 210 | 315 | 833 | 881 | 13 | 1.69 | 4.4 | G | D |
| 19 | 0.01 | 1.2 | 130 | 315 | 789 | 905 | 13 | 1.67 | 3.2 | F | C |
| 20 | 0.004 | 2000 | 110 | 309 | 738 | 938 | 14 | 1.65 | 2.5 | F | B |
| 21 | 0.008 | 2000 | 95 | 397 | 944 | 1119 | 11 | 1.69 | 2.5 | G | B |
| 22 | 0.002 | >10000 | 210 | 355 | 790 | 980 | 14 | 1.70 | 2.4 | VG | A |
| 23 | 0.002 | >10000 | 200 | 360 | 820 | 985 | 12 | 1.72 | 2.4 | VG | A |
| 24 | 0.002 | >10000 | 190 | 363 | 890 | 1023 | 12 | 1.73 | 2.3 | VG | A |
| 25 | 0.002 | >10000 | 190 | 372 | 874 | 1030 | 11 | 1.71 | 2.3 | VG | A |
| 26 | 0.002 | >10000 | 180 | 380 | 886 | 1032 | 12 | 1.69 | 2.4 | VG | A |
| 27 | 0.001 | 5000 | 180 | 379 | 1055 | 1205 | 10 | 1.71 | 2.1 | VG | A |
| 28 | 0.001 | 5000 | 180 | 399 | 1150 | 1210 | 8 | 1.73 | 2.1 | VG | A |
| 29 | 0.003 | 600 | 130 | 325 | 856 | 898 | 16 | 1.67 | 2.7 | F | B |
| 30 | 0.25* | 200 | 60 | 267 | 690 | 793 | 20 | 1.53 | 3.8 | P | D |

Evalulation
A: Developed steel (very good)
B: Developed steel (good)
C: Developed steel (slightly good)
D: Comparative steel
Cold rollability
VG: Very good (no problem at all)
G: Good (fine adjustment required, but no problem)
F: Fair (sheet runnable if adjusting conditions)
P: Poor (large danger of sheet breakage)

Example 3

The steel compositions shown in Table 5 was made into a 250 mm thick slaband final sheets were produced by basically following process. The basic process conditions were a slab heating temperature of 1100° C., a final hot band thickness of 2.0 mm, a coiling temperature of 300° C. or less in hot rolling, a final sheet thickness of 0.2 mm in cold rolling, and a recrystallization annealing temperature of the temperature or more at which the recrystallization occurred. After this, to simulate precipitation heat treatment after punching, a heat treatment at about 750° C. was employed to control texture and precipitation of the metal phase. When the heat treatment simulates stress relief annealing, the precipitation heat treatment was employed in the cooling process after a heat treatment at 750° C. for 2 hours. Each sheet before and after the heat treatments was measured for mechanical properties using a JIS No. 5 test piece and for magnetic flux density $B_{10}$ and core loss $W_{10/400}$ using a 55 mm square SST test. The mechanical properties and magnetic properties were calculated as the average of the values of the rolling direction and the transverse direction of the coil. As for punching die wear, a newly produced punching die was used to punch the steel sheet and the wear was evaluated based on the change of the height of the burrs on the steel sheet in relation to the number of punching. Die with large wear results in large burrs of the steel sheet in a relatively small number of punching. The results are shown in Table 6 (continuation of Table 5).

As clear from the results shown in Table 6, the samples produced under the conditions of the present invention are soft and thus are good in rollability in the cold rolling process and result in small wear of the punching die before the precipitation heat treatment and become hard and superior in magnetic properties after precipitation treatment.

TABLE 5

| | Steel compositions (mass %) | | | | | | | | | Steel sheet heat history | | Precipitation heat treatment | | | Metal phase composed of Cu before precipitation heat treatment | |
|---|---|---|---|---|---|---|---|---|---|---|---|---|---|---|---|---|
| No. | C | Si | Mn | P | S | Al | N | Cu | Other | Hot rolling *1 | Hot rolling *2 | Process | Temperature (° C.) | Holding time (min) | Average size (μm) | Number density (/μm³) |
| 31 | 0.0025 | 1.11 | 0.48 | 0.044 | 0.0016 | 0.004 | 0.0008 | 0.007* | — | 100 | 30 | A | 500 | 60 | — | — |
| 32 | 0.0061 | 1.02 | 0.50 | 0.076 | 0.0014 | 0.002 | 0.0016 | 0.02* | Ni: 2.5 Nb: 0.03 | 30 | 30 | A | 500 | 60 | — | — |
| 33 | 0.0007 | 1.11 | 0.49 | 0.052 | 0.0007 | 0.002 | 0.0006 | 0.53* | — | 30 | 20 | A | 500 | 60 | — | — |
| 34 | 0.0016 | 1.03 | 0.46 | 0.048 | 0.0017 | 0.001 | 0.0025 | 0.89 | — | 60 | 60 | A | 500 | 60 | 0.11 | 0.1 |
| 35 | 0.0006 | 1.12 | 0.46 | 0.052 | 0.0005 | 0.004 | 0.0020 | 0.64 | — | 30 | 5 | A | 500 | 60 | — | — |
| 36 | 0.0021 | 1.01 | 0.50 | 0.061 | 0.0093 | 0.004 | 0.0028 | 0.88 | — | 40 | 5 | A | 500 | 60 | 0.004 | 0.01 |
| 37 | 0.0023 | 1.16 | 0.48 | 0.069 | 0.0310 | 0.004 | 0.0020 | 1.14 | — | 20 | 30 | B | 500 | 60 | — | — |
| 38 | 0.0074 | 1.16 | 0.48 | 0.069 | 0.0310 | 0.004 | 0.0020 | 1.14 | — | 20 | 30 | B | 500 | 60 | — | — |
| 39 | 0.0156 | 1.16 | 0.48 | 0.069 | 0.0310 | 0.004 | 0.0020 | 1.14 | — | 20 | 30 | B | 500 | 60 | — | — |
| 40 | 0.0013 | 1.08 | 0.53 | 0.043 | 0.0017 | 0.003 | 0.0017 | 2.40 | Ca: 0.005 | 60 | 30 | A | 500 | 60 | — | — |
| 41 | 0.0007 | 1.16 | 0.52 | 0.072 | 0.0011 | 0.004 | 0.0009 | 2.33 | Ti: 0.03 | 20 | 20 | B | 650 | 1 | — | — |
| 42 | 0.0006 | 1.17 | 0.52 | 0.071 | 0.0015 | 0.005 | 0.0021 | 2.83 | — | 30 | 20 | A | 400 | 300 | 0.03 | 0.15 |
| 43 | 0.0096 | 1.17 | 0.52 | 0.071 | 0.0015 | 0.005 | 0.0021 | 2.83 | — | 30 | 20 | A | 400 | 300 | 0.03 | 0.15 |
| 44 | 0.0020 | 1.11 | 0.49 | 0.066 | 0.0007 | 0.001 | 0.0025 | 4.25 | Ni: 1.9 | 20 | 10 | A | 350 | 300 | 0.06 | 0.2 |
| 45 | 0.0021 | 1.09 | 0.50 | 0.064 | 0.0013 | 0.001 | 0.0012 | 8.64* | — | 30 | 30 | A | 350 | 300 | 1.3 | 0.03 |

Steel sheet heat history
*1: Residence time at temperature range of 450° C. to 700° C. in cooling process after final rolling of hot rolling (sec)
*2: Residence time in temperature range of 450° C. to 700° C. in cooling process in final annealing after cold rolling (sec)
Precipitation heat treatment
A: Cooling process in stress relief annealing process after working to motor
B: Only precipitation heat treatment after working to motor
*Constitution outside range of claims of present invention

TABLE 6

| | After precipitation heat treatment of metal phase composed of Cu | | Crystal grain | Mechanical properties before and after precipitation heat treatment and changes in same | | | | | | Magnetic properties after precipitation heat treatment | | | | |
|---|---|---|---|---|---|---|---|---|---|---|---|---|---|---|
| No. | Average size (μm) | Number density (/μm³) | average size (μm) | Before Hardness Hv | After Hardness Hv | Comp. Hardness Hv | Before TS (MPa) | After TS (MPa) | Diff. TS (MPa) | $B_{10}$ (T) | $W_{10/400}$ (W/kg) | Cold rollability | Wear of stamping die | Evaluation |
| 31 | — | — | 100 | 121 | 118 | 0.97 | 391 | 361 | −30 | 1.65 | 10.2 | VG | G | C |
| 32 | — | — | 70 | 200 | 154 | 0.77 | 630 | 465 | −165 | 1.25 | 31.3 | F | P | C |
| 33 | 0.002 | 0.02 | | 130 | 125 | 0.96 | 398 | 387 | −11 | 1.60 | 15.5 | VG | G | C |
| 34 | 0.11* | 0.1 | 120 | 118 | 120 | 1.02 | 378 | 363 | −15 | 1.61 | 11.2 | VG | G | C |
| 35 | 0.004 | 10 | 150 | 133 | 166 | 1.25 | 422 | 502 | 80 | 1.69 | 11.8 | VG | G | B |
| 36 | 0.002 | 200 | 120 | 122 | 212 | 1.74 | 408 | 579 | 171 | 1.63 | 8.3 | VG | G | A |
| 37 | 0.004 | 200 | 100 | 146 | 241 | 1.65 | 443 | 616 | 173 | 1.65 | 9.2 | VG | G | A |
| 38 | 0.004 | 200 | 95 | 165 | 295 | 1.79 | 453 | 650 | 197 | 1.67 | 9.3 | VG | G | A |
| 39 | 0.004 | 200 | 100 | 177 | 312 | 1.76 | 460 | 670 | 210 | 1.68 | 9.1 | VG | G | A |
| 40 | 0.001 | 3000 | 70 | 123 | 187 | 1.51 | 386 | 538 | 152 | 1.62 | 9.2 | VG | G | A |
| 41 | 0.003 | 1000 | 70 | 149 | 211 | 1.42 | 457 | 600 | 143 | 1.59 | 11.4 | VG | G | B |
| 42 | 0.001 | >10000 | 80 | 150 | 251 | 1.68 | 454 | 692 | 238 | 1.62 | 12.4 | VG | G | A |
| 43 | 0.001 | >10000 | 85 | 165 | 292 | 1.77 | 460 | 725 | 265 | 1.65 | 12.0 | VG | G | A |

TABLE 6-continued

| | After precipitation heat treatment of metal phase composed of Cu | | Crystal grain | Mechanical properties before and after precipitation heat treatment and changes in same | | | | | | Magnetic properties after precipitation heat treatment | | | | |
|---|---|---|---|---|---|---|---|---|---|---|---|---|---|---|
| No. | Average size (μm) | Number density (/μm³) | average size (μm) | Before Hardness Hv | After Hardness Hv | Comp. Hardness Hv | Before TS (MPa) | After TS (MPa) | Diff. TS (MPa) | $B_{10}$ (T) | $W_{10/400}$ (W/kg) | Cold roll-ability | Wear of stamping die | Eval-uation |
| 44 | 0.002 | 6000 | 70 | 135 | 277 | 2.05 | 440 | 784 | 344 | 1.56 | 12.0 | VG | G | A |
| 45 | 1.05* | 0.11 | 70 | 135 | 146 | 1.08 | 420 | 420 | 0 | 1.43 | 24.5 | G | G | C |

Cold rollability
VG: Very good (no problem at all)
G: Good (fine adjustment required, but no problem)
F: Fair (sheet runnable if adjusting conditions)
P: Poor (large danger of sheet breakage)
Wear of stamping die
G: Good (small)
P: Poor (large)
Evaluation
A: Developed steel (very good)
B: Developed steel (good)
C: Comparative steel

Example 4

The steel compositions shown in Table 7 was made into a 250 mm thick slaband final sheets were produced by basically following process. The basic process conditions were a slab heating temperature of 1100° C., a final hot band thickness of 2.0 mm, a coiling temperature of 300° C. or less in hot rolling, a hot band annealing of 980° C. and 30 seconds, a final sheet thickness of 0.35 mm in cold rolling, and a recrystallization annealing temperature of the temperature or more at which the recrystallization occurred. After this, to simulate precipitation heat treatment after punching, a heat treatment at about 750° C. was employed to control texture and precipitation of the metal phase. When the heat treatment simulates stress relief annealing, the precipitation heat treatment was employed in the cooling process after a heat treatment at 750° C. for 2 hours. Each sheet before and after the heat treatments was measured for mechanical properties using a JIS No. 5 test piece and for magnetic flux density $B_{10}$ and core loss $W_{10/400}$ using a 55 mm square SST test. The mechanical properties and magnetic properties were calculated as the average of the values of the rolling direction and the transverse direction of the coil. As for punching die wear, a newly produced punching die was used to punch the steel sheet and the wear was evaluated based on the change of the height of the burrs on the steel sheet in relation to the number of punching. Die with large wear results in large burrs of the steel sheet in a relatively small number of punching. The results are shown in Table 8 (continuation of Table 7).

As clear from the results shown in Table 8, the samples produced under the conditions of the present invention are soft and thus are good in rollability in the cold rolling process and result in small wear of the punching die before the precipitation heat treatment and become hard and superior in magnetic after the precipitation treatment.

TABLE 7

| | Steel compositions (mass %) | | | | | | | | | Steel sheet heat history | | Precipitation heat treatment | | | Before precipitation heat treatment of metal phase composed of Cu | |
|---|---|---|---|---|---|---|---|---|---|---|---|---|---|---|---|---|
| No. | C | Si | Mn | P | S | Al | N | Cu | Other | Hot rolling *1 | Hot rolling *2 | Pro-cess | Temper-ature (° C.) | Holding time (min) | Average size (μm) | Number density (/μm³) |
| 46 | 0.0017 | 2.94 | 0.28 | 0.014 | 0.0010 | 0.47 | 0.0018 | 0.03* | — | 40 | 20 | B | 550 | 10 | — | — |
| 47 | 0.0065 | 2.86 | 0.34 | 0.013 | 0.0015 | 0.49 | 0.0025 | 0.03* | Ni: 2.5 Nb: 0.03 | 30 | 10 | B | 550 | 10 | — | — |
| 48 | 0.0024 | 2.86 | 0.34 | 0.014 | 0.0007 | 0.54 | 0.0022 | 0.48* | — | 100 | 20 | B | 550 | 10 | — | — |
| 49 | 0.0016 | 2.85 | 0.28 | 0.015 | 0.0014 | 0.54 | 0.0013 | 0.66 | — | 30 | 30 | B | 550 | 10 | — | — |
| 50 | 0.0013 | 2.88 | 0.34 | 0.019 | 0.0017 | 0.46 | 0.0011 | 0.96 | — | 30 | 20 | B | 550 | 10 | 0.05 | 0.02 |
| 51 | 0.0011 | 2.88 | 0.31 | 0.017 | 0.0004 | 0.50 | 0.0021 | 1.16 | Se: 0.012 | 120 | 20 | B | 550 | 10 | 0.04 | 0.01 |
| 52 | 0.0288 | 2.88 | 0.31 | 0.017 | 0.0004 | 0.50 | 0.0021 | 1.16 | Se: 0.012 | 120 | 20 | B | 550 | 10 | 0.04 | 0.01 |
| 53 | 0.0011 | 2.88 | 0.31 | 0.017 | 0.0004 | 0.50 | 0.0021 | 1.16 | Se: 0.012 | 120 | 20 | A | 550 | 20 | 0.04 | 0.03 |
| 54 | 0.0024 | 2.89 | 0.27 | 0.018 | 0.0016 | 0.53 | 0.0016 | 1.90 | — | 30 | 5 | A | 550 | 20 | 0.12 | 0.04 |
| 55 | 0.0023 | 2.91 | 0.25 | 0.011 | 0.0012 | 0.55 | 0.0028 | 1.93 | Nb: 0.03 | 20 | 10 | B | 600 | 5 | — | — |
| 56 | 0.0014 | 2.92 | 0.31 | 0.016 | 0.0007 | 0.45 | 0.0022 | 1.88 | Ca: 0.005 | 60 | 20 | A | 450 | 900 | 0.02 | 0.03 |
| 57 | 0.0005 | 2.87 | 0.29 | 0.014 | 0.0013 | 1.20 | 0.0022 | 2.60 | — | 900 | 10 | A | 450 | 300 | 0.35 | 0.2 |
| 58 | 0.0014 | 2.90 | 0.25 | 0.018 | 0.0005 | 1.05 | 0.0016 | 3.95 | Ni: 2.5 | 20 | 10 | A | 450 | 150 | 0.04 | 0.04 |
| 59 | 0.0010 | 2.91 | 0.31 | 0.013 | 0.0006 | 1.51 | 0.0028 | 4.89 | — | 20 | 5 | B | 720 | 0.3 | 0.06 | 0.02 |

TABLE 7-continued

| No. | Steel compositions (mass %) C | Si | Mn | P | S | Al | N | Cu | Other | Steel sheet heat history: Hot rolling *1 | Hot rolling *2 | Precipitation heat treatment: Process | Temperature (° C.) | Holding time (min) | Before precipitation heat treatment of metal phase composed of Cu: Average size (μm) | Number density (/μm³) |
|---|---|---|---|---|---|---|---|---|---|---|---|---|---|---|---|---|
| 60 | 0.0132 | 2.91 | 0.31 | 0.013 | 0.0006 | 1.51 | 0.0028 | 4.89 | — | 20 | 5 | B | 720 | 0.3 | 0.06 | 0.02 |
| 61 | 0.0023 | 2.91 | 0.32 | 0.019 | 0.0015 | 0.48 | 0.0029 | 8.33* | — | 20 | 30 | A | 450 | 60 | 1.7 | 0.02 |

Precipitation heat treatment
A: Cooling process in stress relief annealing process after working to motor
B: Only precipitation heat treatment after working to motor
Steel sheet heat history
*1: Residence time at temperature range of 450 to 700° C. in cooling process after final rolling of hot rolling (sec)
*2: Residence time in temperature range of 450 to 700° C. in cooling process in final annealing after cold rolling (sec)
*Constitution outside range of claims of present invention

TABLE 8

| No. | Precipitation heat treatment of metal phase composed of Cu: Average size (μm) | Number density (/μm³) | Crystal grain average size (μm) | Mechanical properties before and after precipitation heat treatment and changes in same: Before Hardness Hv | After Hardness Hv | Comp. Hardness Hv | Before TS (MPa) | After TS (MPa) | Dif. TS (MPa) | Magnetic properties after precipitation heat treatment: $B_{50}$ (T) | $W_{15/500}$ (W/kg) | Cold rollability | Wear of stamping die | Evaluation |
|---|---|---|---|---|---|---|---|---|---|---|---|---|---|---|
| 46 | — | — | 150 | 176 | 182 | 1.04 | 530 | 530 | 0 | 1.65 | 2.5 | VG | G | C |
| 47 | — | — | 60 | 250 | 222 | 0.89 | 768 | 662 | −106 | 1.20 | 8.7 | F | P | C |
| 48 | 0.01 | 0.1 | 130 | 168 | 166 | 0.99 | 530 | 552 | 22 | 1.68 | 2.7 | VG | G | C |
| 49 | 0.003 | 0.1 | 130 | 168 | 193 | 1.15 | 515 | 611 | 96 | 1.68 | 2.5 | VG | G | B |
| 50 | 0.002 | 20 | 170 | 174 | 220 | 1.27 | 543 | 710 | 167 | 1.71 | 2.2 | VG | G | B |
| 51 | 0.003 | 3000 | 130 | 171 | 255 | 1.49 | 529 | 783 | 254 | 1.69 | 2.3 | VG | G | A |
| 52 | 0.003 | 3000 | 110 | 213 | 322 | 1.51 | 583 | 830 | 247 | 1.70 | 2.5 | VG | G | A |
| 53 | 0.004 | 1000 | 120 | 171 | 267 | 1.57 | 529 | 779 | 250 | 1.68 | 2.5 | VG | G | A |
| 54 | 0.004 | 80 | 120 | 169 | 224 | 1.33 | 521 | 609 | 88 | 1.66 | 2.4 | VG | G | B |
| 55 | 0.001 | >10000 | 90 | 167 | 280 | 1.68 | 518 | 816 | 298 | 1.62 | 2.7 | VG | G | A |
| 56 | 0.002 | 100 | 180 | 179 | 311 | 1.74 | 531 | 857 | 326 | 1.66 | 2.4 | VG | G | A |
| 57 | 0.006 | 100 | 100 | 218 | 256 | 1.17 | 690 | 744 | 54 | 1.64 | 3.0 | F | G | B |
| 58 | 0.003 | 4000 | 140 | 230 | 350 | 1.52 | 710 | 1150 | 440 | 1.65 | 2.2 | G | G | B |
| 59 | 0.002 | >10000 | 150 | 171 | 358 | 2.09 | 515 | 1155 | 640 | 1.67 | 2.2 | VG | G | A |
| 60 | 0.002 | >10000 | 150 | 201 | 408 | 2.03 | 604 | 1175 | 571 | 1.70 | 2.1 | VG | G | A |
| 61 | 0.76* | 0.05 | 120 | 230 | 245 | 1.07 | 654 | 705 | 51 | 1.40 | 6.0 | G | G | C |

Cold rollability
VG: Very good (no problem at all)
G: Good (fine adjustment required, but no problem)
F: Fair (sheet runnable if adjusting conditions)
P: Poor (large danger of sheet breakage)
Wear of stamping die
G: Good (small)
P: Poor (large)
Evaluation
A: Developed steel (very good)
B: Developed steel (good)
C: Comparative steel

INDUSTRIAL APPLICABILITY

As explained above, the present invention enables stable production of a high strength electrical steel sheet which is hard and superior in magnetic properties. Furthermore, according to the present invention, it becomes possible to provide an electrical steel sheet having good workability at the time of processing to an electrical part and which is hard and good in magnetic properties at the time of use as an electrical part through a stable process conditions causing no refinement of texture and no trouble such as sheet breakage, by not allowing formation of almost any fine metal phase mainly composed of Cu in the steel sheet in the process of the production and by forming the metal phase in a heat treatment process after processing to an electrical part. Due to this, it becomes possible to secure strength, fatigue strength, and wear resistance without degrading the magnetic properties, and so greater efficiency, smaller size, superlonger lifetime, etc. of superhigh speed motors, motors incorporating magnets in rotors, and electromagnetic switch materials can be achieved.

The invention claimed is:

1. A high strength non-oriented electrical steel sheet characterized by consisting essentially of, by mass %, C: 0.06% or less, Si: 3.1 to 3.5%, Mn: 0.5 to 1.2%, P: 0.30% or less, S or Se: 0.040% or less, Al: 0.005% or less, Cu: 0.6 to 8.0%, Cr: 4.5% or less, N: 0.0031 to 0.0301%, and a balance of Fe and unavoidable impurities, said steel sheet having an average crystal grain size of 30 to 300 μm by holding the steel sheet in a heat treatment at 800° C. to 1100° C. for 20 seconds to 5 minutes and containing a metal phase comprised of Cu having a diameter of 0.1 μm or less and a number density of 20 /$\mu m^3$ or more in the steel sheet by holding the steel sheet in a heat treatment at a temperature range of 300° C. to 650° C. for 5 seconds or more.

2. A high strength non-oriented electrical steel sheet characterized by consisting essentially of, by mass %, C: 0.06% or less, Si: 3.1 to 3.5%, Mn: 0.5 to 1.2%, P: 0.30% or less, S or Se: 0.040% or less, Al: 0.005% or less, Cu: 0.6 to 8.0%, Cr: 4.5% or less, N: 0.0031 to 0.0301%, one or more of Nb: 8% or less, Ti: 1.0% or less, B: 0.010% or less, and Ni: 5% or less, and one or more of Bi, Mo, W, Sn, Sb, Mg, Ca, Ce, La, and Co in a total of 0.5% or less, and a balance of Fe and unavoidable impurities, said steel sheet having an average crystal grain size of 30 to 300 μm by holding the steel sheet in a heat treatment at 800° C. to 1100° C. for 20 seconds to 5 minutes and containing a metal phase comprised of Cu having a diameter of 0.1 μm or less and a number density of 20 /$\mu m^3$ or more in the steel sheet by holding the steel sheet in a heat treatment at a temperature range of 300° C. to 650° C. for 5 seconds or more.

3. A high strength non-oriented electrical steel sheet as set forth in claim 2, characterized in that the steel sheet contains a Nb carbide or nitride.

4. A processed part of a high strength non-oriented electrical steel sheet as set forth in any one of claims 1, 2 and 3, wherein the part is heat treated after processing for a shaping step to form the processed part so that the metal phase comprised mainly of Cu present in the processed part has a number density of 20 /$\mu m^3$ or more, wherein the number density of the metal phase is increased by 10-fold or more after the heat treatment, wherein the metal phase has an average size of 0.1 μm or less, wherein the part has an average crystal grain size of 3 to 300 μm, and wherein the tensile strength of the part is increased by 30 MPa or more and hardness of the part is increased by 1.1-fold or more after the heat treatment.

5. A high strength non-oriented electrical steel sheet characterized by consisting essentially of, by mass %, C: 0.06% or less, Si: 2.5 to 3.5%, Mn: 0.5 to 1.2%, P: 0.30% or less, S or Se: 0.040% or less, Al: 0.005% or less, Cu: 0.6 to 8.0%, Cr: 4.5% or less, N: 0.0031 to 0.0301%, and a balance of Fe and unavoidable impurities, said steel sheet having an average crystal grain size of 30 to 300 μm by holding the steel sheet in a heat treatment at 800° C. to 1100° C. for 20 seconds to 5 minutes and containing a metal phase comprised of Cu having a diameter of 0.1 μm or less and a number density of 20 /$\mu m^3$ or more in the steel sheet by holding the steel sheet in a heat treatment at a temperature range of 300° C. to 650° C. for 5 seconds or more.

* * * * *